US008777688B2

(12) United States Patent
Barthold

(10) Patent No.: US 8,777,688 B2
(45) Date of Patent: Jul. 15, 2014

(54) TOY ACTION FIGURE

(75) Inventor: Mark J. Barthold, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 1369 days.

(21) Appl. No.: 12/211,757

(22) Filed: Sep. 16, 2008

(65) Prior Publication Data

US 2009/0075555 A1 Mar. 19, 2009

Related U.S. Application Data

(60) Provisional application No. 60/972,813, filed on Sep. 16, 2007.

(51) Int. Cl.
*A63H 3/20* (2006.01)

(52) U.S. Cl.
USPC ..... 446/330

(58) Field of Classification Search
USPC ..... 446/4, 268, 308, 330, 486, 487
See application file for complete search history.

(56) References Cited

U.S. PATENT DOCUMENTS

| | | | | | |
|---|---|---|---|---|---|
| 2,042,270 | A | * | 5/1936 | Moore et al. | 446/51 |
| 2,151,546 | A | | 3/1939 | Arnold | |
| 2,810,985 | A | | 10/1957 | Bilder | |
| 3,425,153 | A | * | 2/1969 | Crosman et al. | 446/308 |
| 4,030,239 | A | * | 6/1977 | White et al. | 446/321 |
| 4,109,411 | A | * | 8/1978 | Wetherell et al. | 446/61 |
| 4,568,304 | A | * | 2/1986 | Santa Maria | 446/321 |
| 5,073,140 | A | | 12/1991 | Lebensfeld et al. | |
| 5,147,237 | A | | 9/1992 | Kwan et al. | |
| 6,699,094 | B1 | * | 3/2004 | Ward | 446/175 |
| 6,837,769 | B1 | | 1/2005 | Skov et al. | |
| 2006/0270307 | A1 | | 11/2006 | Montalvo et al. | |
| 2006/0292963 | A1 | | 12/2006 | Sun et al. | |

* cited by examiner

*Primary Examiner* — Gene Kim
*Assistant Examiner* — Alyssa Hylinski
(74) *Attorney, Agent, or Firm* — The Mueller Law Office, P.C.

(57) ABSTRACT

A toy action figure includes a cape and a spring-loaded arm. The upper torso of the toy action figure includes two pivotally coupled arms. The first pivotally coupled arm is configured to retract the cape. An actuator button may be provided on the front of the torso to actuate the cape into an extended position with the assistance of a spring. The second pivotally coupled arm may include a spring-loaded arm to launch a projective therefrom.

14 Claims, 12 Drawing Sheets

TOY ACTION FIGURE

CROSS REFERENCE TO RELATED APPLICATIONS

The present application claims the priority and benefit of U.S. Provisional Application 60/972,813 filed on Sep. 16, 2007, which is hereby incorporated by reference in its entirety herein.

BACKGROUND OF THE INVENTION

Toy action figures have become an extremely popular and well known type of product in the toy arts. Toy action figures often resemble character-oriented heroes and villains. Common character themes for such action figures include warriors, soldiers and athletes, as well as science-fiction character themes, such as robots, cyborgs, androids and superheroes, and fantasy characters, such as wizards, gnomes and trolls. While the appearance and physical size of toy action figures may vary substantially, most toy action figures include a plastic body formed in a shape corresponding to the associated character theme. The plastic body of an action figure is often movable by joints. Many toy action figures provide additional movement features to further enhance the play value of the figure. Such movement features may include, for example, the ability to punch or kick. In many instances, accessories such shields and weapons are also provided for use in combination with toy action figures. Despite substantial success in the market place on the part of such action figures, there remains a continuing need in the art for more interesting and exciting toy action figures.

SUMMARY OF THE INVENTION

A toy action figure is disclosed herein. In one aspect, the toy action figure includes a body having an upper torso. A compartment is configured about a portion of the upper torso. The toy action figure, in various aspects, includes a cape having a concealed position and an extended position. The cape is generally contained within the compartment in the concealed position and the cape is generally extended forth from the compartment in the extended position.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION

Figure 1:
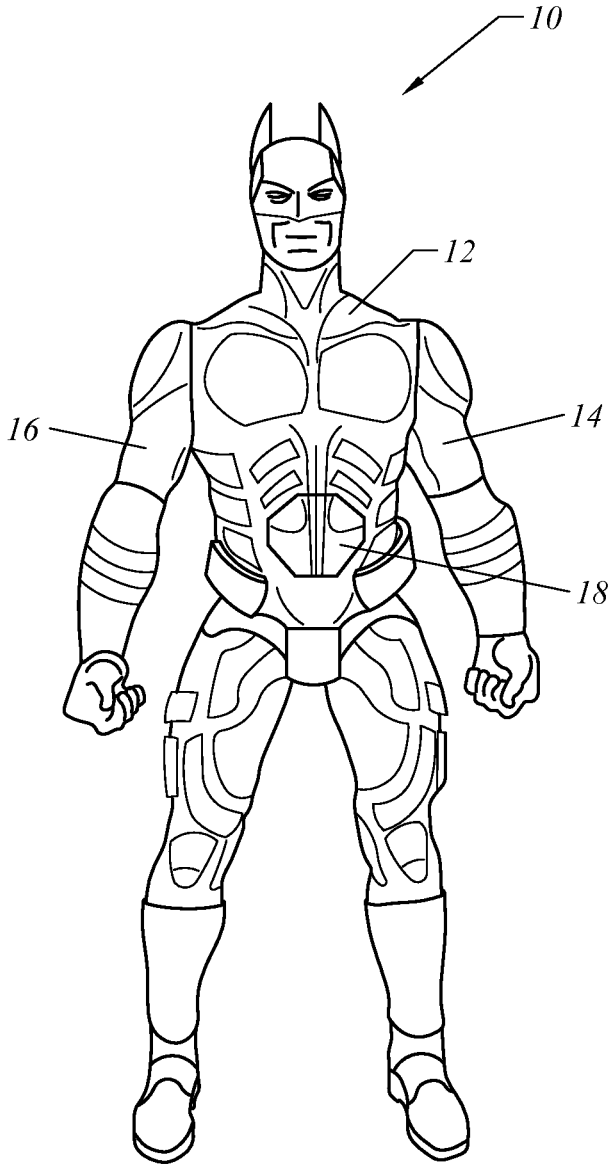
FIG. 1 illustrates a front elevation view of an exemplary embodiment of a toy action figure.
Figure 2:
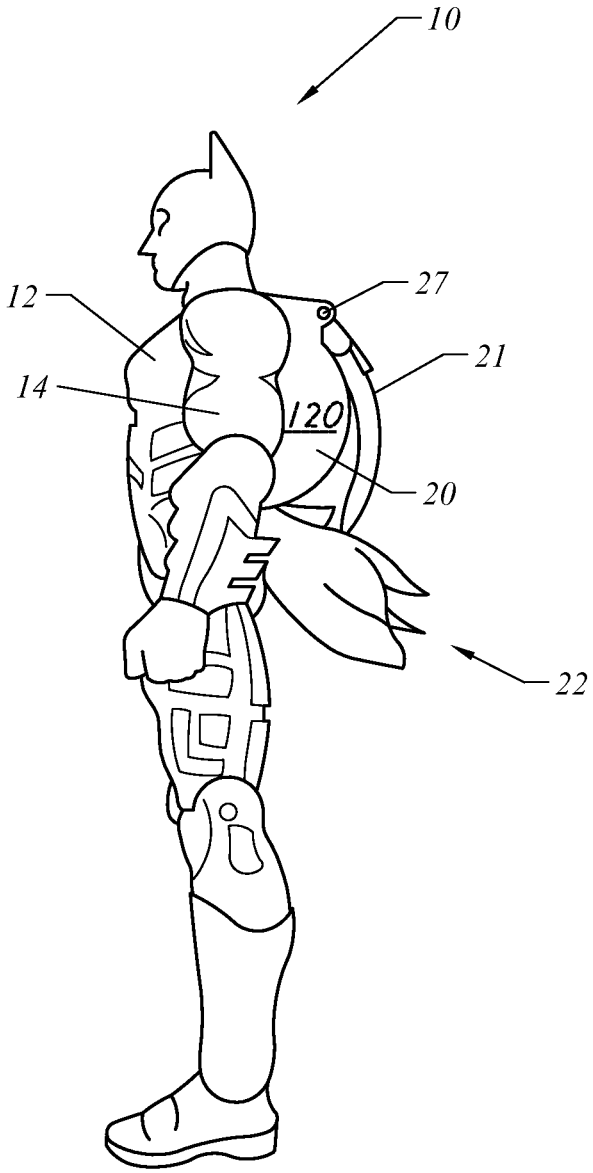
FIG. 2 illustrates a side elevation view of the toy action figure of FIG. 1.
Figure 10:
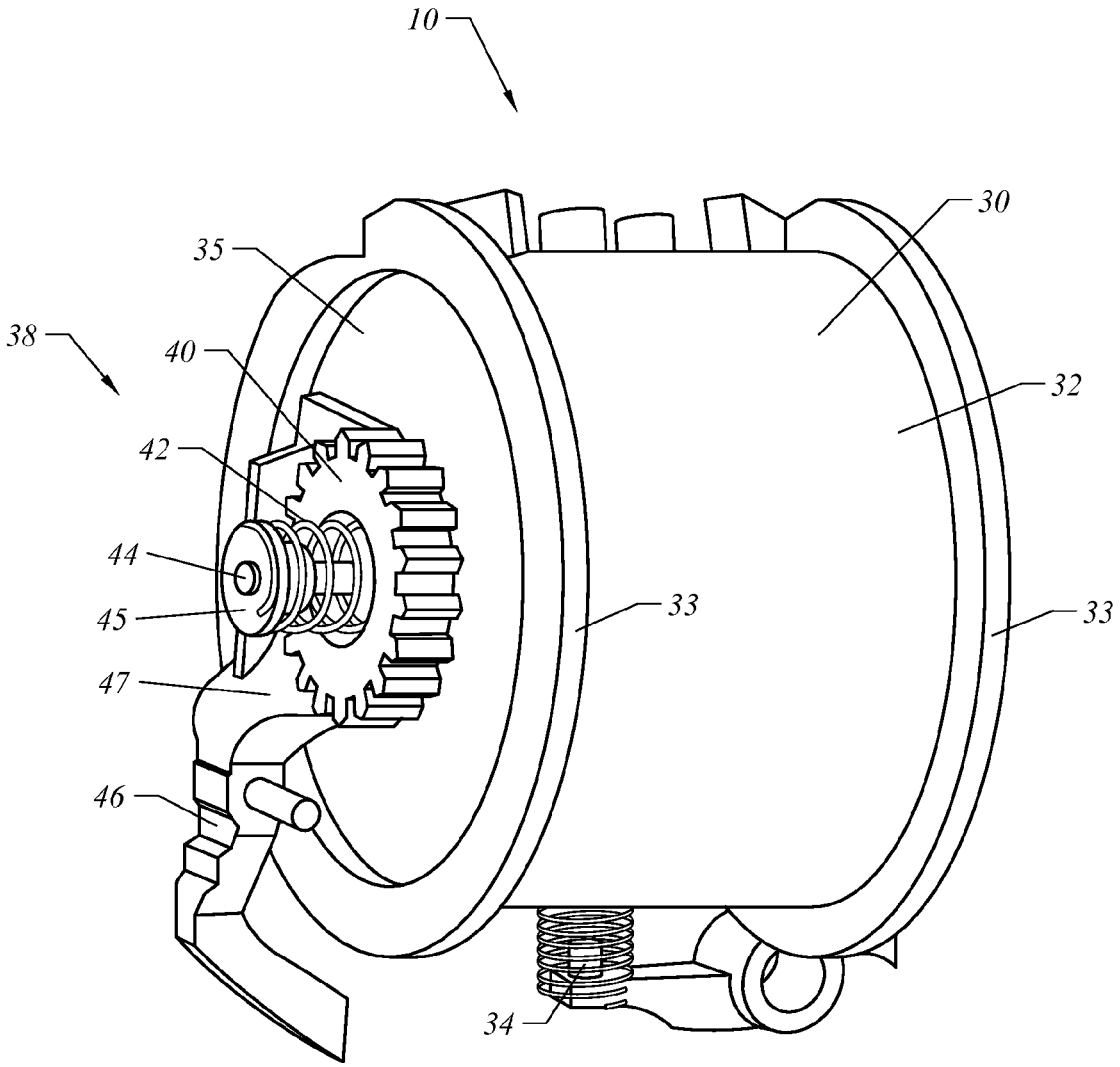
FIG. 10 illustrates a side perspective view of an exemplary drum with related components of a ratchet assembly.

FIG. 1 illustrates an exemplary embodiment of a toy action FIG. 10 in accordance with the present invention. The toy action FIG. 10 is formed in the shape of a fictional character. The toy action FIG. 10 may, however, be formed in the shape of various characters, including but not limited to warriors, soldiers, athletes, robots, cyborgs, androids and the like. The toy action FIG. 10 is formed with a body and limbs that correspond to the character theme of the toy action FIG. 10. The toy action FIG. 10 may be formed from a suitable material such as plastic. The toy action FIG. 10, as illustrated, includes an upper torso 12. The upper torso 12 is configured to enclose a springing cape 22 (FIG. 2). A first arm 14 and a second arm 16, in this implementation, are pivotally coupled to the upper torso 12. The first arm 14, in this implementation, performs functions associated with the springing cape 22. The second arm 16 may perform functions associated with a throwing action in this implementation. The front of the upper torso 12 in this implementation includes an actuator button 18 for actuating the springing cape 22.

FIG. 2 illustrates a side view of the toy action figure of FIG. 1. As illustrated, the upper torso 12 of the toy action FIG. 10 forms a portion of a compartment 120, and a lid 21 hingedly secured by hinge 27 about the upper torso 12 of the toy action FIG. 10 encloses the compartment 120. The lid 21 is generally biased about other portions of the toy action FIG. 10 to enclose the compartment 120. The compartment 120 generally encloses and conceals a springing cape 22. In this implementation, compartment 120 is illustrated as a portion of the toy action FIG. 10 formed as a backpack 20, but compartment 120 may be formed, at least in part, as a shirt, a vest, the back of the toy action figure, or the like. Thus, lid 21 may formed as a portion of an object such as a backpack as in FIG. 2, or formed as a portion of a shirt, vest, part of the upper torso 12 or otherwise formed about the toy action FIG. 10.

The springing cape 22 has a concealed position and an extended position, and the user moves the springing cape 22 between these positions. Springing cape 22 is shown in FIG. 2 in a semi-concealed position, as the springing cape 22 is moved between the extended position and the concealed position. In the concealed position, springing cape 22 may be fully retracted into the toy action FIG. 10 to be enclosed and concealed within the compartment 120.

Figure 3:
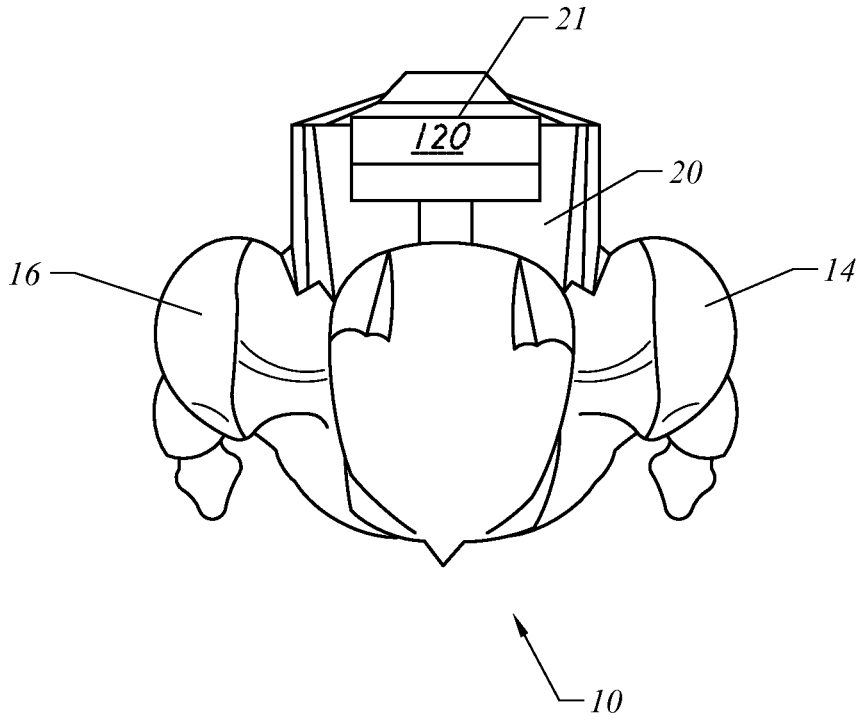
FIG. 3 illustrates a top plan view of the toy action figure of FIG. 1.

FIG. 3 is a top plan view of an implementation of the toy action FIG. 10 in which the first arm 14, second arm 16, compartment 120, and lid 21 are visible. Springing cape 22 is fully retracted into the back of upper torso 12 of toy action FIG. 10, and, therefore, not seen in this FIG. 3.

Figure 4:
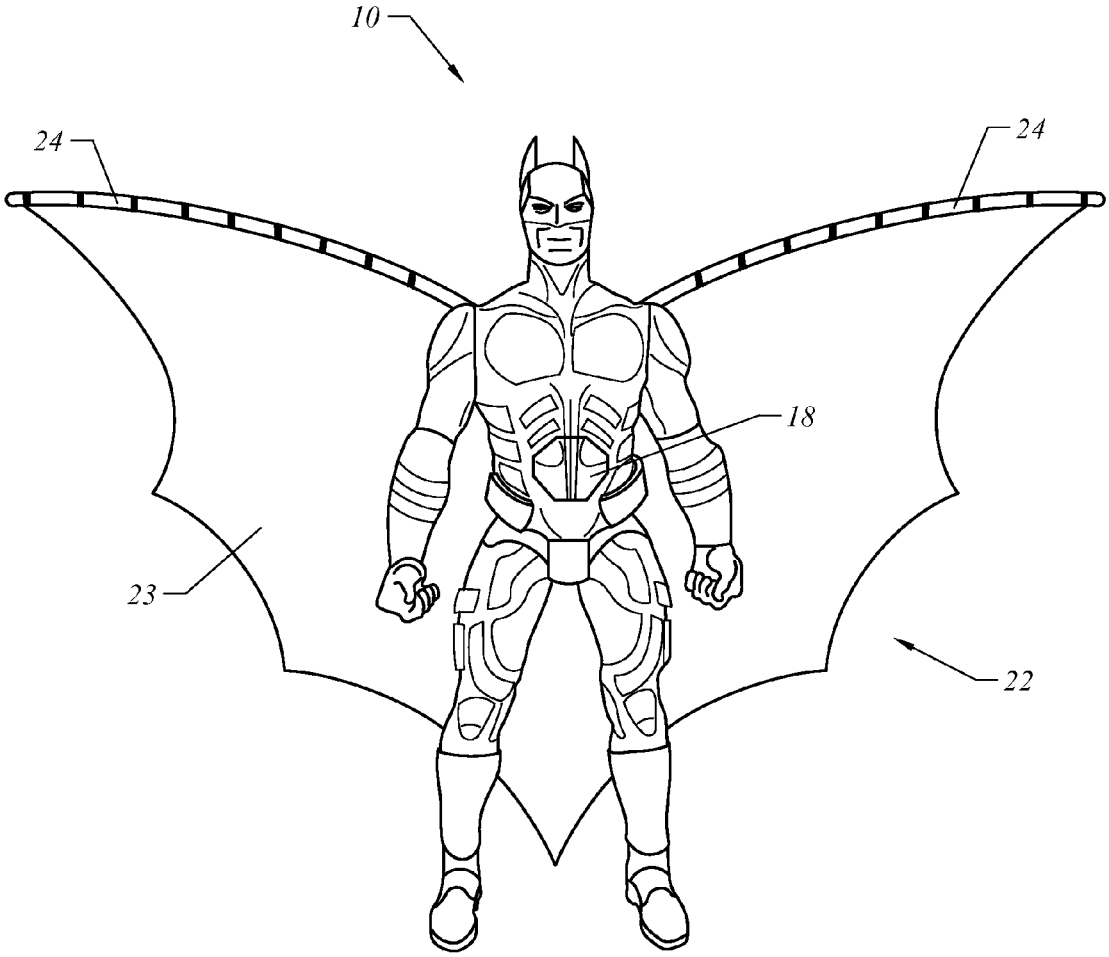
FIG. 4 illustrates a front elevation view of the toy action figure of FIG. 1 with the springing cape in an extended position.

FIG. 4 illustrates a front view of an implementation of the toy action FIG. 10 of FIG. 1 with the springing cape 22 in the extended position. The extended position is achieved when the actuator button 18 on the front of the upper torso 12 in this implementation is actuated by a user. The actuator button 18 may be pushable, slidable, or otherwise formed to be actuated by the user in various implementations. When actuated, the actuator button 18 releases the springing cape 22 from the concealed position such that the springing cape 22 springs forth from the compartment 120 and opens into the extended position. The lid 21, as illustrated, pivots on the hinge 27 to allow the springing cape 22 to spring forth from the chamber 120. As can be seen when in the extended position, the springing cape 22 includes a fabric portion 23 and two resilient strip members 24 in this implementation. In other implementations, the springing cape 22 may include more or fewer resilient strip members 24. The fabric portion 23 forms the body of the springing cape 22 and may, for example, be formed in the shape of wings or a cape.

Figure 11:
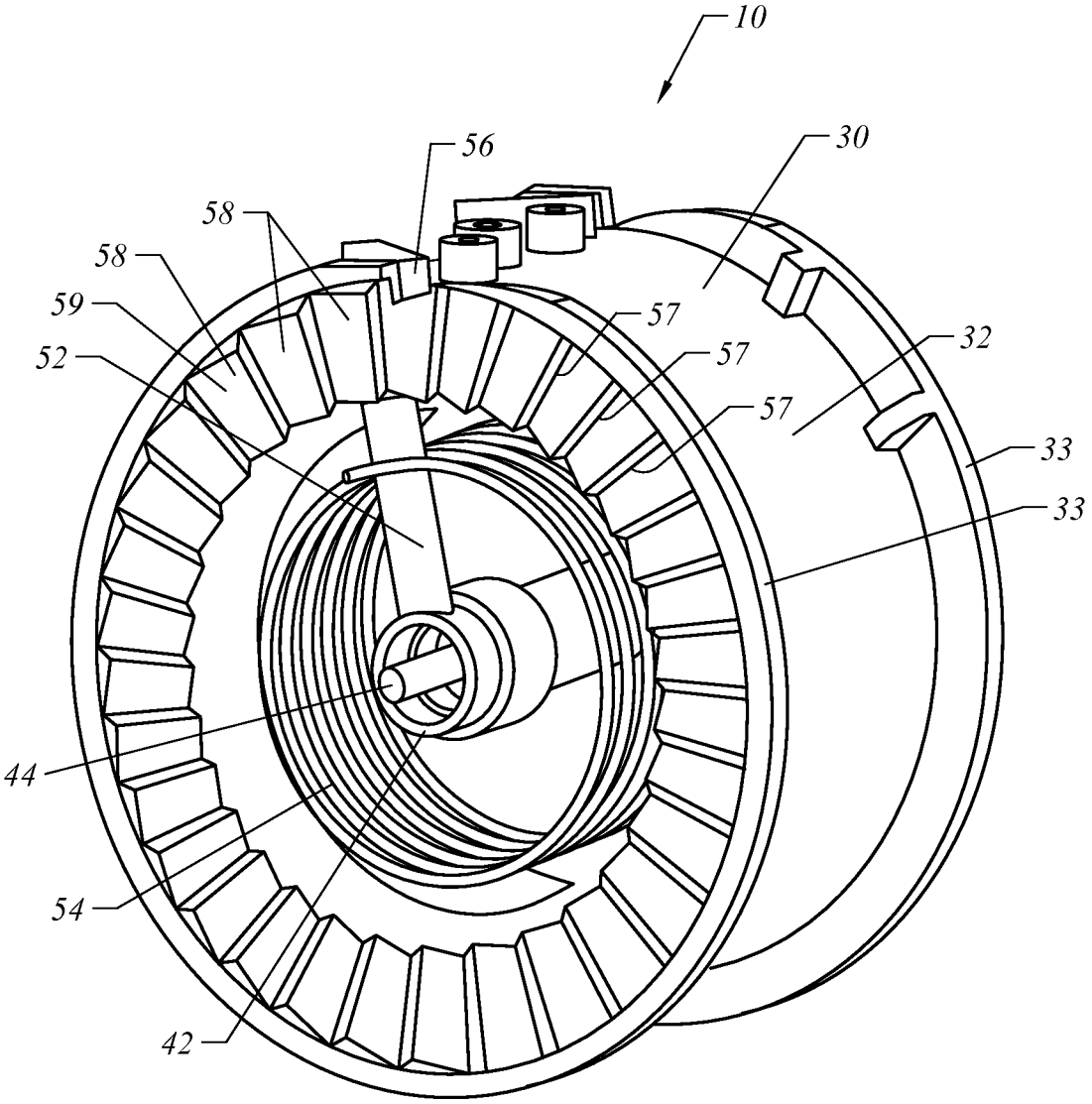
FIG. 11 illustrates a side perspective view of the inside of an exemplary drum.

The fabric portion 23 and the resilient strip members 24 are configured to retract into the upper torso 12 of the toy action FIG. 10. Returning to FIG. 2, when the user motions the first arm 14, the springing cape 22 may be retracted from the extended position into the compartment 120 to be positioned in the concealed position within the compartment 120. As illustrated, the first arm 14 is pivotably coupled to the upper torso 12 such that first arm 14 can be motioned by rotating the first arm 14 through a succession of ratcheting motions. As the first arm 14 is so rotated, the springing cape 22 is wound around a drum 30 (see FIGS. 9, 10, 11) located generally within compartment 120. A single ratcheting motion may be, for example, movement of the first arm 14 through an angle of about 90 degree in a counter-clockwise direction, followed by movement of the first arm 14 through an angle of about 90 degrees in a clockwise direction. In some embodiments, the first arm 14 may be moved in a circular, cranking motion either clockwise or counterclockwise to retract springing cape 22 around the drum 30 and compress the associated spring 54 (FIG. 11). In still other embodiments, the arm may be moved in a circular, cranking motion to release the springing cape 22 from the compartment 120 into the expanded position. In FIG. 2, springing cape 22 is shown in a partially retracted position.

Figure 5:
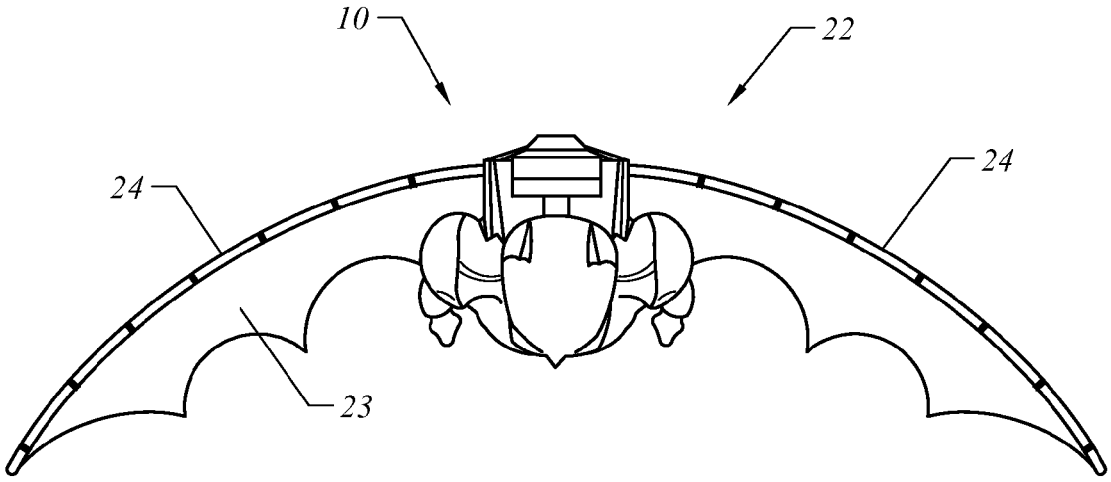
FIG. 5 illustrates a top plan view of the toy action figure of FIG. 1 with the springing cape in an extended position.
Figure 6:
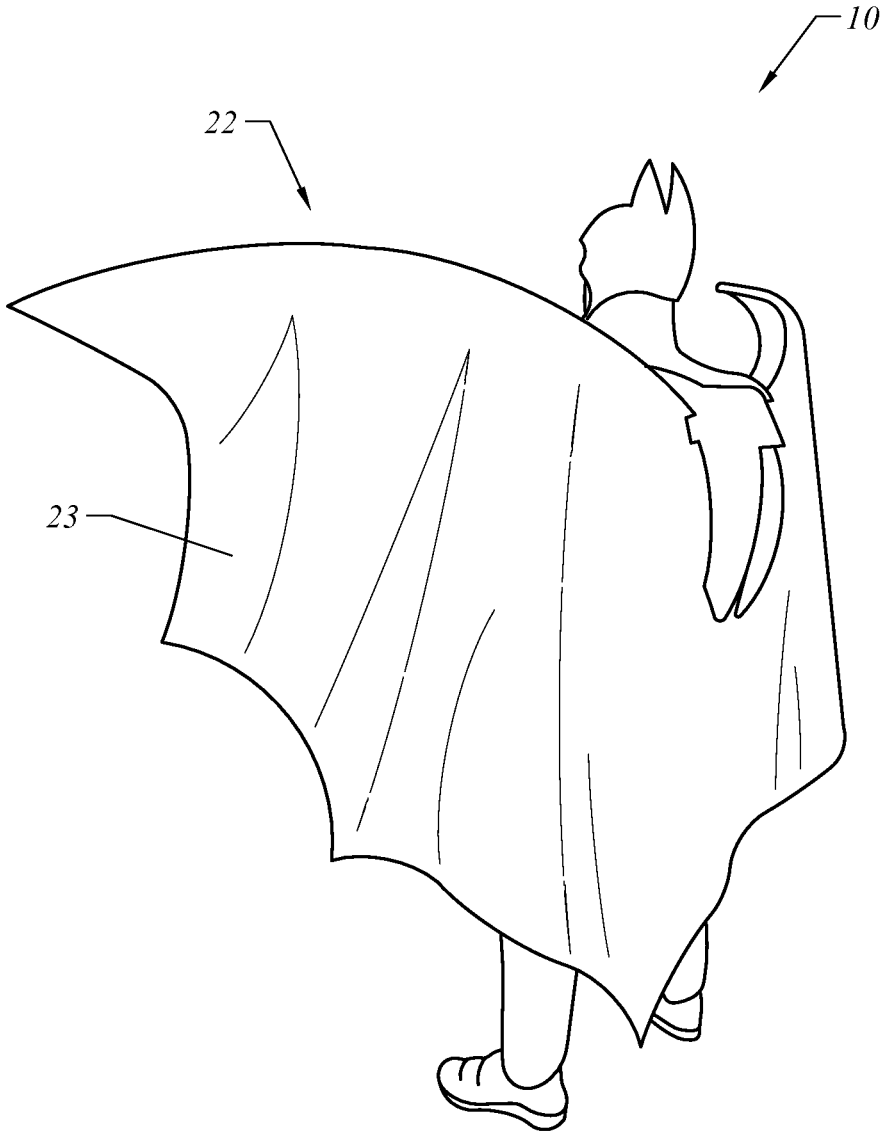
FIG. 6 illustrates a rear perspective view of the toy action figure of FIG. 1 with the springing cape in an extended position.
Figure 7:
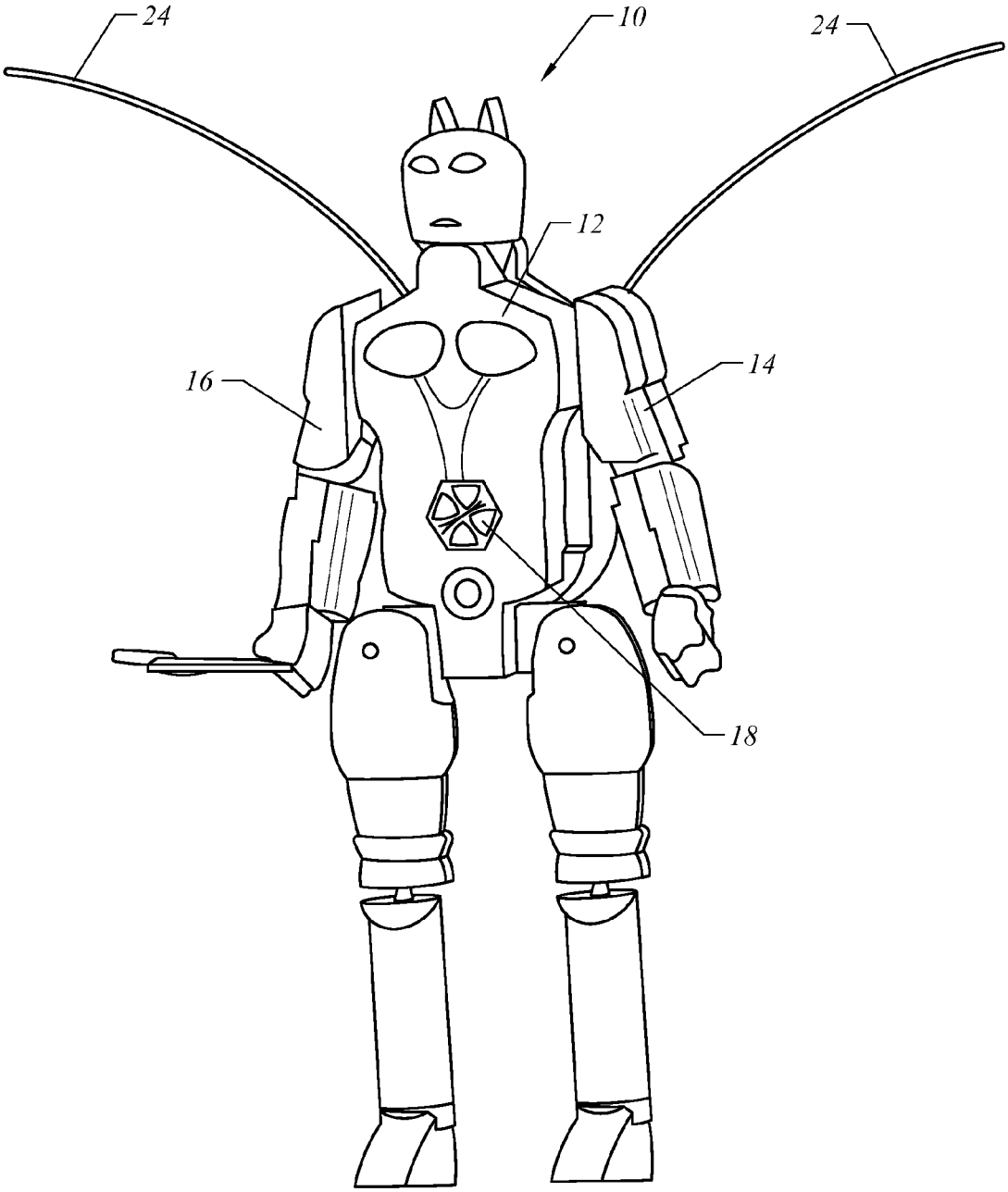
FIG. 7 is an assembly drawing that illustrates a front elevation view of the action figure of FIG. 1.

FIG. 5 illustrates a top plan view of the toy action FIG. 10 in which the fabric portion 23 and resilient strip members 24 of the springing cape 22 are visible. FIG. 6 illustrates a rear perspective view of an implementation of the toy action FIG. 10 in which the fabric portion 23 of the springing cape 22 is visible. FIG. 7 illustrates by assembly drawing a front view of an implementation of the toy action FIG. 10. The layout for upper torso 12, first arm 14, second arm 16, actuator button 18, and resilient strip members 24 in an implementation of the toy action FIG. 10 is generally illustrated in FIG. 7. Resilient strip members 24 are illustrated in the extended position without the associated fabric portion 23.

Figure 8:
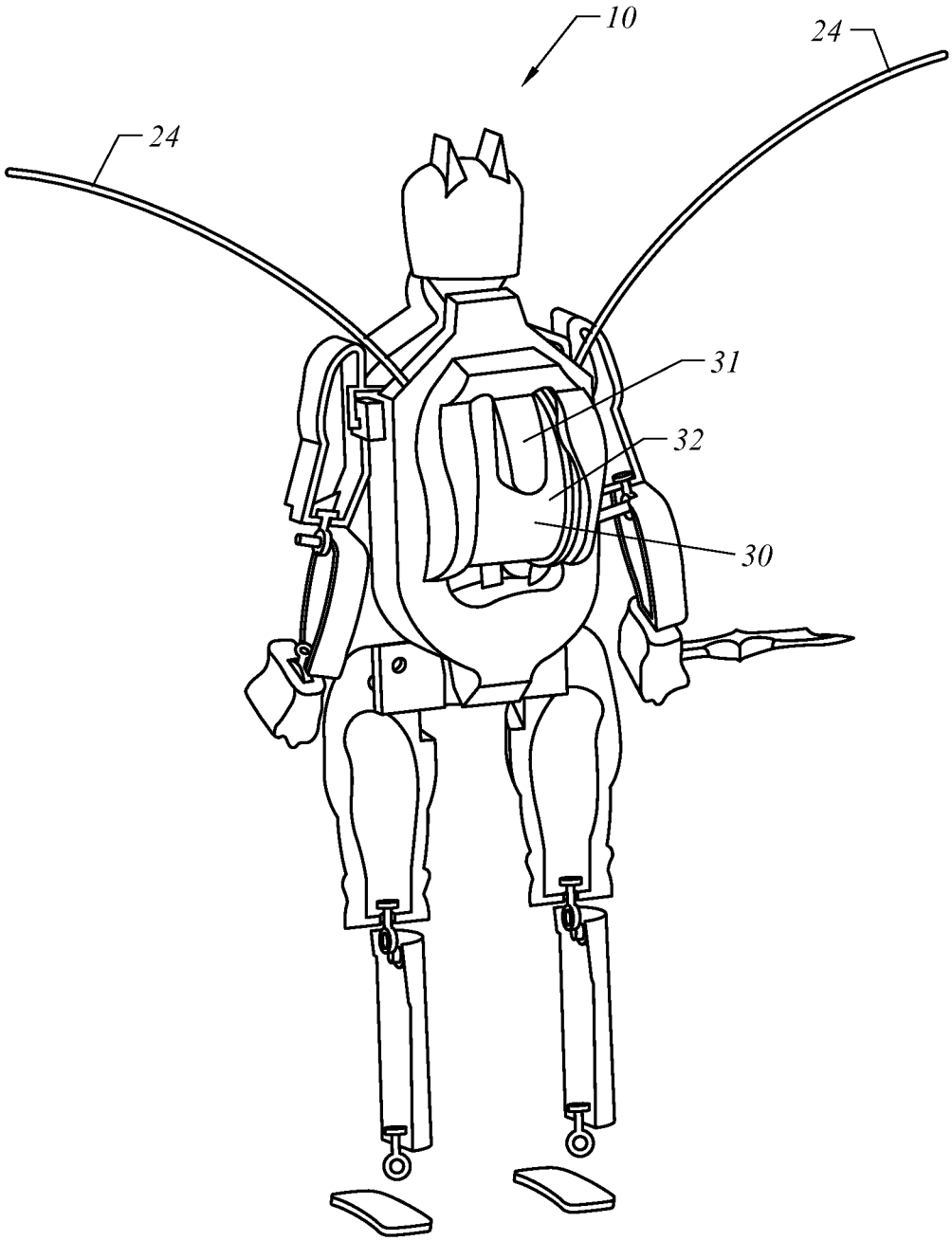
FIG. 8 is an assembly drawing that illustrates a rear perspective view of the drum located within an exemplary embodiment of the toy action figure.

FIG. 8 illustrates by an assembly drawing a rear perspective view of an implementation of drum 30 as the drum 30 is housed within toy action FIG. 10. The drum 30 is configured to facilitate the storage of the springing cape 22 in the concealed position by enabling the circular wrapping of the springing cape 22 including the fabric portion 23 and resilient strip members 24 around a drum outer surface 32 of the drum 30. A lip 31 generally disposed within compartment 120 is used to direct the springing cape 22 around the drum outer surface 32 of drum 30 as the springing cape 22 is retracted into the compartment 120 from the expanded position to the concealed position. The resilient strip members 24 are in the extended position without the associated fabric portion 23 as illustrated in the implementation of FIG. 8.

Figure 9:
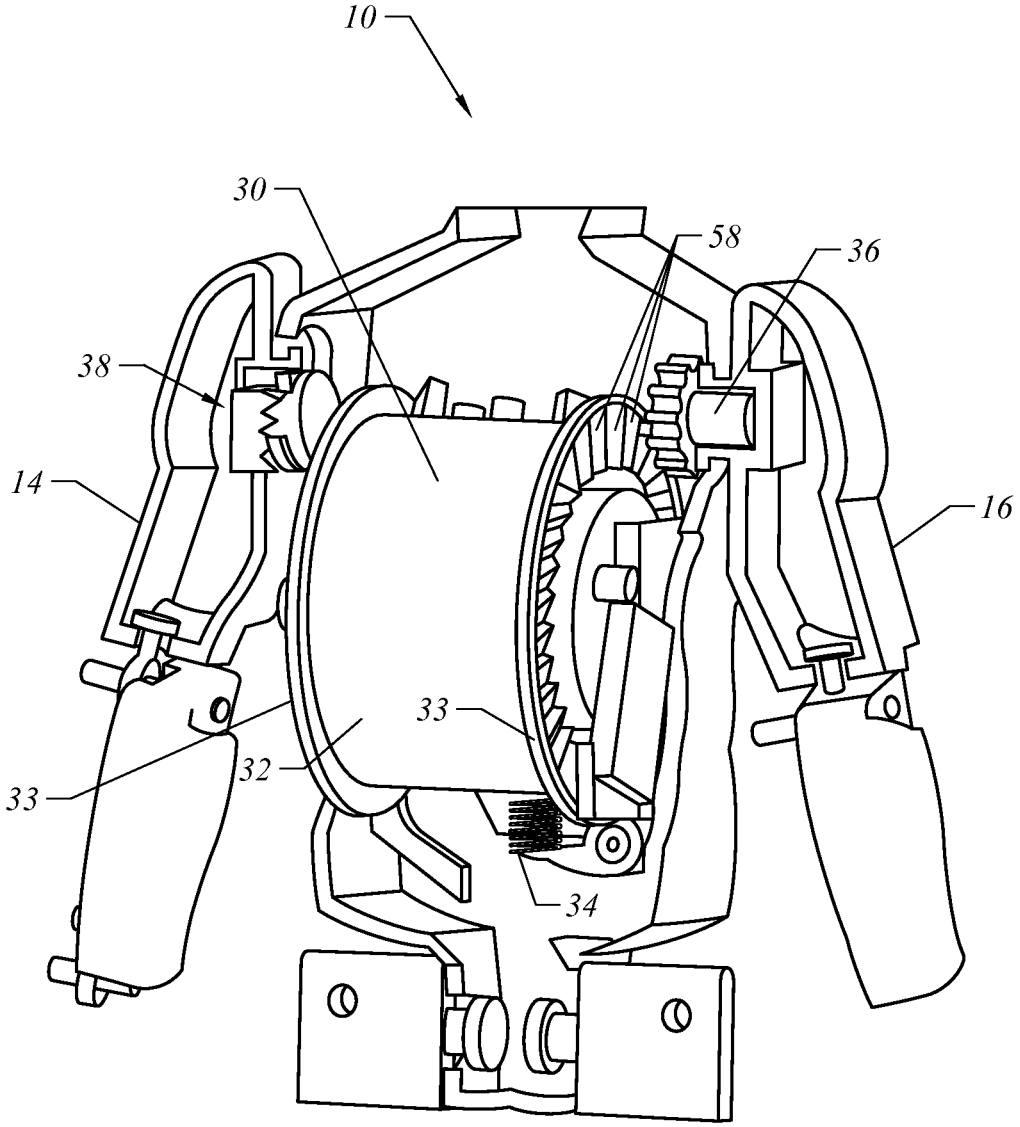
FIG. 9 illustrates a side perspective view of an exemplary drum located within the toy action figure.

FIG. 9 illustrates a side perspective view of the drum 30 located within the toy action FIG. 10. In this exemplary implementation, rails 33 located peripherally about the drum outer surface 32 of drum 30 direct the springing cape 22 onto drum outer surface 32 of drum 30 as the springing cape 22 is retracted from the expanded position to the concealed position. The toy action FIG. 10 may include a ratchet assembly 38, as illustrated, that allows the user to return the springing cape 22 to the concealed position through a series of ratcheting motions of, for example, first arm 14 of the toy action FIG. 10. The toy action FIG. 10 may include various additional springs, such as spring 34 to facilitate the ratcheting of the springing cape. Also illustrated in FIG. 9 is gear 36 associated with the optional throwing action of the toy action figure that is discussed below with reference to FIG. 12.

FIG. 10 illustrates a side perspective view of an exemplary drum 30 along with related components of a ratchet assembly 38. Ratchet assembly 38 may include a gear 40, a spring 42, an axle 44, and a lever 46 for linking ratchet assembly 38 to first arm 14 of the toy action FIG. 10. As illustrated, gear 40 is fixedly secured to a drum side surface 35 of drum 30 and lever 46 is secured to the first arm 14 that in turn is rotationally secured to the upper torso 12 such that, when first arm 14 is rotated either clockwise or counterclockwise, lever 46 is rotated correspondingly about gear 40. In this implementation, when lever 46 is rotated in a counterclockwise direction, the lever end 47 of lever 46 engages with gear 40 to rotate the drum about axis 44. The springing cape 22, a portion of which is secured to the drum 30, is then gathered over the drum outer surface 32 of the drum 30 as the drum 30 so rotates. The lever end 47 of lever 46 disengages from gear 40 when the lever 46 is rotated in the clockwise direction to allow the lever 46 to rotate freely in the clockwise direction. Accordingly, a ratcheting motion may be applied to the first arm 14 to rotate the drum 30 and, hence, gather the springing cape 22 thereupon.

FIG. 11 illustrates a side perspective view of the inside of an exemplary drum. The inside of drum 30 may include a lever 52 and a spring 54. Spring 54 is engaged with drum 30 so that, as drum 30 is rotated in the counterclockwise direction, spring 54 is tensioned to apply a force that would rotate drum 30 in the clockwise direction. With continuing reference to the implementation of FIG. 11, the drum 30 is configured with teeth 58 having flat faces 57 and angled faces 59. Pawl 56 engages the flat faces 57 to prevent rotation of the drum 30 in the clockwise direction. The pawl 56 generally slides over the angled faces 59 when the drum is rotated in the counterclockwise direction so that rotation of the drum in the counterclockwise direction is generally not impeded by the pawl 56. The pawl 56 cooperates mechanically with axle 44 and is held against the flat face 57 by spring 42 (FIG. 10). When sufficient force is applied to axle end 45 of axle 44 to compress spring 42, axle 44 slides axially such that pawl 56, which cooperates with axle 44, is disengaged from flat face 57. When pawl 56 is disengaged from flat face 57, the tension, if any, accrued in the spring 54 causes the drum 30 to rotate in the clockwise direction. The spring cape 22, if wound around drum outer surface 32 of drum 30 would be thereby unwound from the drum outer surface 32 of drum 30 to be positioned in the expanded position.

In various implementations, the actuator button 18 may mechanically cooperate with axle 44 such that actuation of the actuator button 18 compresses the spring 42 so that axle 44 slides axially and pawl 56 is thereby disengaged from flat face 57. When the pawl 57 is disengaged from flat face 57, the drum 30 rotates to deploy the springing cape 22 into the expanded position.

Figure 12:
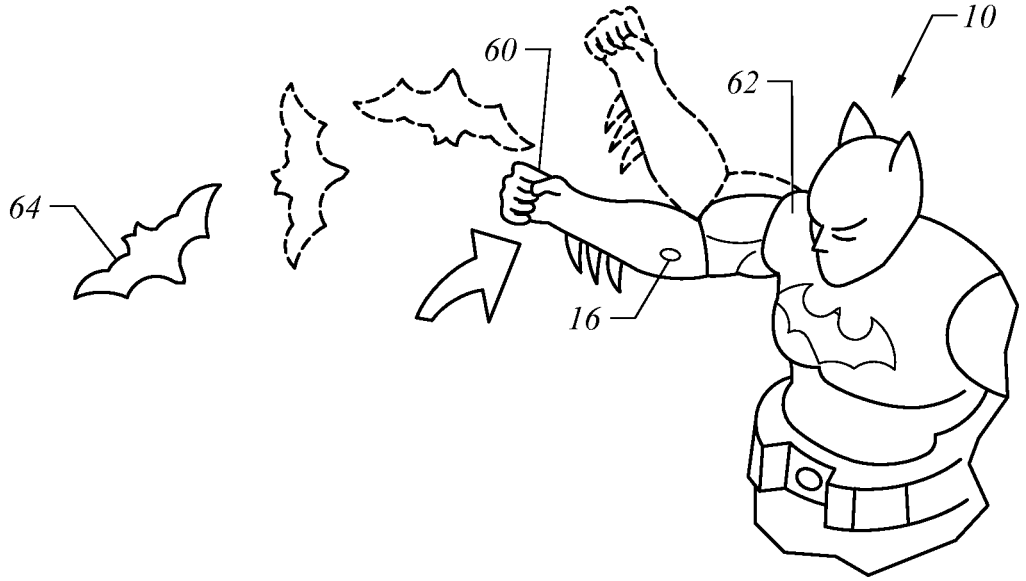
FIG. 12 illustrates an exemplary embodiment of the toy action figure that includes a spring-loaded arm for launching a projectile.

FIG. 12 illustrates an embodiment of the toy action FIG. 10 of FIG. 1 that includes a spring-loaded arm 16 for launching a projectile 64. The spring-loaded arm 16, as illustrated, is pivotally coupled to the upper torso of the toy action FIG. 10 at an elbow 62. The spring-loaded arm 16 includes an attachment point 60 for removably attaching the projectile 64. The attachment point 60 is configured to hold the projectile 64 while the spring-loaded arm 16 is forced by the user into a throwing position. The attachment point 60 may be formed, for example, in the shape of a hand. The projectile 64 may be formed, for example, in the shape of an object corresponding to the character theme of the toy action FIG. 10. When the user rotates the spring-loaded arm 16, a throwing force is developed by an internal spring (not shown). When the user releases the spring-loaded arm 16, the projectile 64 is launched.

While the specification has been described in detail with respect to specific embodiments, it will be appreciated that those of ordinary skill in the art, upon attaining an understanding of the foregoing, may readily conceive of alterations to, variations of, and equivalents to these embodiments. These and other modifications and variations may be practiced by those of ordinary skill in the art, without departing from the spirit and scope of the appended claims. Furthermore, the foregoing description is by way of example only, and is not intended to limit the invention. Thus, it is intended that the present subject matter covers such modifications and variations as fall within the scope of the appended claims and their equivalents.

What is claimed is:

1. A toy action figure comprising:

a body having an upper torso;

a compartment configured about a rear portion of the upper torso;

a springing cape having a concealed position and an extended position, wherein the cape is generally contained within the compartment in the concealed position and the cape is generally extended forth from the compartment in the extended position;

a first arm secured about the torso, the first arm adapted to place the springing cape from the extended position into the concealed position by motions thereof; and a drum, wherein the drum cooperates with the first arm to receive the cape thereupon as the first arm is motioned to place the cape in the concealed position.

2. The toy action figure, as in claim 1, further comprising:

a lid hingedly secured about the compartment to enclose a portion of the compartment.

3. The toy action figure, as in claim 1, further comprising:

an actuator button on the body in mechanical cooperation with the cape to place the cape from the concealed position into the extended position as the actuator button is actuated.

4. The toy action figure, as in claim 1, further comprising:

a ratchet assembly in communication with the first arm and the drum, the ratchet assembly adapted to restrict rotation of the drum as the cape is placed into the concealed position by motions of the first arm.

5. The toy action figure, as in claim 1, further comprising:

an actuator button; and the drum with the cape in the concealed position disposed thereupon, the drum cooperates with the actuator button to place the cape into the extended position when the actuator button is actuated.

6. The toy action figure, as in claim 1, wherein the drum is in mechanical cooperation with the first arm such that motions of the first arm cause the drum to rotate in a first rotational direction, the drum adapted to receive the cape onto a drum surface upon rotation in the first rotational direction and to release the cape from the drum surface upon rotation in a second rotational direction; and wherein the toy action figure further comprises:

a spring in cooperation with the drum, the spring adapted to gather tension directed to rotate the drum in the second rotational direction as the drum is rotated in the first rotational direction;

an actuator button; and a pawl releaseably engaged with the drum, the pawl adapted to prevent rotation of the drum in the second rotational direction when engaged with the drum, the pawl mechanically cooperates with the actuator button such that actuation of the actuator button releases engagement of the pawl with the drum to allow the drum to rotate in the second rotational direction.

7. The toy action figure, as in claim 1, wherein the cape comprises a fabric cape portion and two resilient strips.

8. The toy action figure, as in claim 1, further comprising:

a spring-loaded arm having an attachment point for removably attaching a projectile, wherein the spring-loaded arm is configured to be rotated by a user against an internal spring to develop a throwing force and wherein the spring-loaded arm is configured to be released by the user to launch the projectile.

9. The toy action figure, as in claim 1, further comprising a compression spring for providing a force to extend the springing cape from the concealed position to the extended position.

10. A toy action figure comprising:

a body having an upper torso;

a compartment configured about a rear portion of the upper torso;

a cape having a concealed position and an extended position, wherein the cape is generally contained within the compartment in the concealed position and the cape is generally extended forth from the compartment in the extended position;

a first arm secured about the torso, the first arm adapted to place the cape from the extended position into the concealed position by motions thereof; and a drum, the drum cooperates with the first arm to receive the cape thereupon as the first arm is motioned to place the cape in the concealed position.

11. The toy action figure, as in claim 10, wherein the first arm is adapted to place the cape from the concealed position into the extended position by motions thereof.

12. The toy action figure, as in claim 10, further comprising:

a ratchet assembly in communication with the first arm and the drum, the ratchet assembly adapted to restrict rotation of the drum as the cape in placed into the concealed position by motions of the first arm.

13. The toy action figure, as in claim 10, wherein the cape comprises a fabric cape portion and two resilient strips.

14. The toy action figure, as in claim 10, further comprising:

a spring-loaded arm having an attachment point for removably attaching a projectile, wherein the spring-loaded arm is configured to be rotated by a user against an internal spring to develop a throwing force and wherein the spring-loaded arm is configured to be released by the user to launch the projectile.

* * * * *